US007980225B2

(12) United States Patent
Yamanari

(10) Patent No.: US 7,980,225 B2
(45) Date of Patent: Jul. 19, 2011

(54) FUEL SUPPLY DEVICE FOR INTERNAL COMBUSTION ENGINE

(75) Inventor: Kenji Yamanari, Chiryu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 204 days.

(21) Appl. No.: 12/521,835

(22) PCT Filed: Apr. 8, 2008

(86) PCT No.: PCT/JP2008/056949

§ 371 (c)(1),
(2), (4) Date: Jun. 30, 2009

(87) PCT Pub. No.: WO2008/126842

PCT Pub. Date: Oct. 23, 2008

(65) Prior Publication Data

US 2010/0043752 A1 Feb. 25, 2010

(30) Foreign Application Priority Data

Apr. 10, 2007 (JP) ..... 2007-102838

(51) Int. Cl.
*F02M 69/54* (2006.01)

(52) U.S. Cl. ..... 123/447; 123/456; 123/457

(58) Field of Classification Search ..... 123/447, 123/456, 457

See application file for complete search history.

(56) References Cited

U.S. PATENT DOCUMENTS

| | | | | |
|---|---|---|---|---|
| 5,954,031 | A | 9/1999 | Ogiso et al. | |
| 6,135,092 | A | 10/2000 | Schaenzer et al. | |
| 6,155,235 | A * | 12/2000 | Kilgore | 123/467 |
| 7,789,071 | B2 * | 9/2010 | Akita et al. | 123/447 |

FOREIGN PATENT DOCUMENTS

| | | |
|---|---|---|
| JP | 2534493 | 9/1996 |
| JP | 9 195885 | 7/1997 |
| JP | 2000 104636 | 4/2000 |
| JP | 2004 232472 | 8/2004 |
| JP | 2006-105080 | * 4/2006 |
| JP | 2008-261238 | * 10/2008 |
| WO | 99 22135 | 5/1999 |

* cited by examiner

*Primary Examiner* — Hai H Huynh
(74) *Attorney, Agent, or Firm* — Oblon, Spivak, McClelland, Maier & Neustadt, L.L.P.

(57) ABSTRACT

A device includes two fuel injection systems and a pulsation damper. Each system includes fuel injection valves and first and second delivery pipes. While fuel is pumped to the two fuel injection systems with a common fuel pump, the device intermittently drives the fuel injection valves to open, thereby supplying the fuel within the delivery pipes from the fuel injection valves. The paths through which the fuel passes include a first passageway, which has the first delivery pipe and a communication path, and a second passageway which has a branch path and the second delivery pipe. An opposing portion opposite to the opening of a placement channel in the first delivery pipe includes the opening of the branch path in the first delivery pipe. This enables one pulsation damper to precisely suppress fuel pressure pulsations occurring in the two delivery pipes.

5 Claims, 2 Drawing Sheets

FUEL SUPPLY DEVICE FOR INTERNAL COMBUSTION ENGINE

FIELD OF THE INVENTION

The present invention relates to a fuel supply device for an internal combustion engine comprising two fuel injection systems, each having a delivery pipe for storing fuel and a fuel injection valve provided in the delivery pipe.

BACKGROUND OF THE INVENTION

A fuel supply device for an internal combustion engine includes delivery pipes for storing fuel that is fed under pressure by a fuel pump and supplies fuel by controlling opening of a fuel injection valve connected to each delivery pipe. In the internal combustion engine, since fuel is injected intermittently from the fuel injection valve, the pressure of the fuel is unavoidably pulsated inside the delivery pipes while the injection of the fuel is alternately executed and stopped. This pulsation of the fuel pressure would lead to various kinds of disadvantages such as occurrence of noises or degradation in efficiency of pumping fuel by the fuel pump.

For this reason, as with a fuel supply device disclosed in Japanese Patent No. 2534493, most of the conventional fuel supply devices are provided with a pulsation damper in a fuel passageway through which fuel is fed under pressure to each fuel injection valve, thereby preventing the pulsation of fuel pressure. The device disclosed in Japanese Patent No. 2534493 is provided with one pulsation damper for two delivery pipes connected in series.

In the device disclosed in Japanese Patent No. 2534493, fuel pressure pulsations caused inside each of the delivery pipes interfere with each other before they reach and are then suppressed by the pulsation damper. Such interference of pressure pulses would cause complicated variations in the amplitude and frequency of the pressure pulses, thereby making it extremely difficult to precisely suppress them by means of one pulsation damper.

Provision of separate pulsation dampers, one for each of the two delivery pipes, would make it possible to prevent the fuel pressure from being pulsated in each delivery pipe while preventing the interference between the pressure pulses. However, such one additional pulsation damper would undesirably add the costs of the overall device as well as results in increase in its size for installation.

SUMMARY OF THE INVENTION

It is an object of the present invention to provide a fuel supply device for an internal combustion engine comprising one pulsation damper that can precisely suppress fuel pressure pulsations caused inside two delivery pipes.

To address the above-mentioned problems, a fuel supply device for an internal combustion engine is provided. The device includes two fuel injection systems and a pulsation damper. Each of the two fuel injection systems has a delivery pipe for storing fuel and a fuel injection valve provided on the delivery pipe. The delivery pipe of one of the fuel injection systems is a first delivery pipe while the delivery pipe of the other fuel injection system is a second delivery pipe. The device drives intermittently the fuel injection valve to open while pumping fuel to the two fuel injection systems with a common fuel pump, thereby supplying the fuel within the first and second delivery pipes. The device further comprises a first passageway through which fuel passes, a second passageway through which fuel passes, and a pressure introduction path for introducing fuel pressure into the pulsation damper. The first passageway includes the first delivery pipe and a communication path for communicating the first delivery pipe with the fuel pump. The second passageway is branched at a location closer to the fuel pump than to the fuel injection valve in the first passageway and connected to the second delivery pipe. The second passageway includes the second delivery pipe and a branch path. The branch path has an opening at the branch location. An opposing portion in the first passageway to which the opening of the pressure introduction path is opposed includes part of the opening of the branch path such that the part of the opening of the branch path opposes to the opening of the pressure introduction path.

In one aspect of the present invention, the entire opening of the branch path may be included in the opposing portion.

In another aspect of the invention, the pressure introduction path may be a placement channel branched from the first passageway. The pulsation damper may include an introduction path for introducing fuel pressure therein. The introduction path may be provided in the placement channel with the introduction path being kept open inside the placement channel.

In still another aspect of the invention, a return path for returning excessive fuel inside the first and second passageways to a fuel tank may be connected to a portion of the first passageway closer to the fuel pump than to the branch location.

In yet another aspect of the invention, the internal combustion engine may have cylinders in a V-shaped arrangement. Each fuel injection system may be disposed in corresponding bank of the internal combustion engine.

DETAILED DESCRIPTION OF THE PREFERRED EMBODIMENTS

Now, a preferred embodiment of a fuel supply device for an internal combustion engine of the invention will be described. The fuel supply device, according to this embodiment, is applicable to an internal combustion engine having cylinders arranged in a V-shape.

Figure 1:
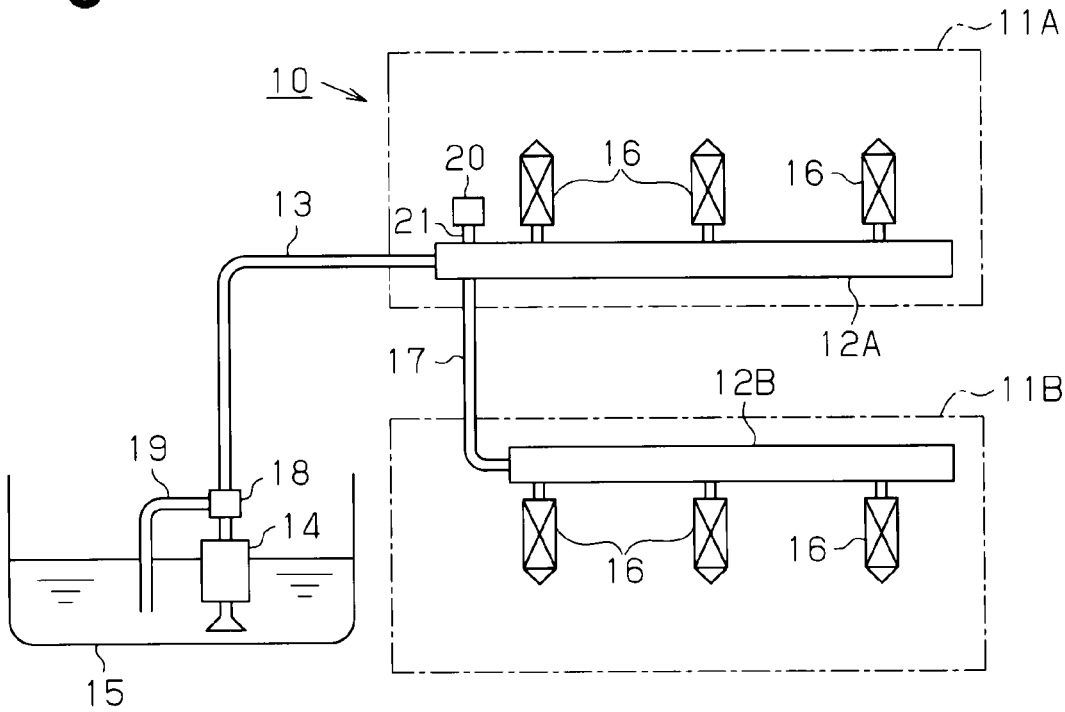
FIG. 1 is a schematic view illustrating a fuel supply device for an internal combustion engine according to an embodiment of the present invention.

FIG. 1 is a schematic view illustrating the configuration of a fuel supply device for an internal combustion engine according to this embodiment. As illustrated in FIG. 1, a delivery pipe 12A is provided in a first bank 11A of an internal combustion engine 10 and a delivery pipe 12B is provided in a second bank 11B.

The first delivery pipe 12A is connected at its one end with a communication path 13, which in turn communicates with a fuel tank 15 via a motor-driven fuel pump 14. A branch path 17 is provided to the delivery pipe 12A branch and extend from an intermediate portion of the delivery pipe 12A, more specifically, the portion which is closer to the communication path 13 than a plurality of fuel injection valves 16 provided on the delivery pipe 12A. The branch path 17 is connected to an end of the second delivery pipe 12B. The branch path 17 allows the delivery pipes 12A and 12B to communicate with each other. In operation of the internal combustion engine 10, the fuel is pumped by driving of the fuel pump 14 through the communication path 13 and the branch path 17 and introduced into each delivery pipe 12A and 12B to be stored therein.

In this manner, the fuel supply device according to this embodiment includes, as passageways through which fuel passes, two passageway systems of a first passageway and a second passageway. The first passageway is made up of the delivery pipe 12A and the communication path 13. The second passageway is made up of the delivery pipe 12B and the branch path 17.

A pressure regulator 18 is disposed between the delivery pipe 12A and the fuel pump 14 in the communication path 13, and the pressure regulator 18 is connected with a return path 19. The pressure regulator 18 is a pressure activated valve that is opened when the fuel pressure within the communication path 13 has exceeded a predetermined pressure.

In this embodiment, when fuel is fed under pressure to each of the delivery pipes 12A and 12B, an excessive amount of fuel fed under pressure by the fuel pump 14 is returned to the fuel tank 15 through the pressure regulator 18 and the return path 19, so that the fuel pressure within the communication path 13 is maintained at desired pressure.

Furthermore, each of the delivery pipes 12A and 12B is provided with a plurality of (in this embodiment, three) fuel injection valves 16. The fuel injection valves 16 are located separately at the positions that correspond to a plurality of (in this embodiment, six) cylinders of the internal combustion engine 10.

Each of the fuel injection valves 16 is intermittently driven to open according to the operational status of the internal combustion engine 10. This allows an appropriate amount of fuel to be injected through the fuel injection valves 16 to each cylinder of the internal combustion engine 10 with the timing associated with the running condition thereof.

In this embodiment, the delivery pipe 12A and the three fuel injection valves 16 provided on the delivery pipe 12A serve as a first fuel injection system, while the delivery pipe 12B and the three fuel injection valves 16 provided on the delivery pipe 12B function as a second fuel injection system.

The fuel supply device according to this embodiment further includes a pulsation damper 20. The pulsation damper 20 operates to suppress the fuel pressure pulsations that would be caused inside each of the delivery pipes 12A and 12B by each of the fuel injection valves 16 being intermittently driven to open.

The pulsation damper 20 of this embodiment positively serves to suppress fuel pressure pulsations that occur separately in each of the delivery pipes 12A and 12B.

Now, description will be presented in detail to the placement of the pulsation damper 20 and its operation resulting from such placement.

Figure 2:
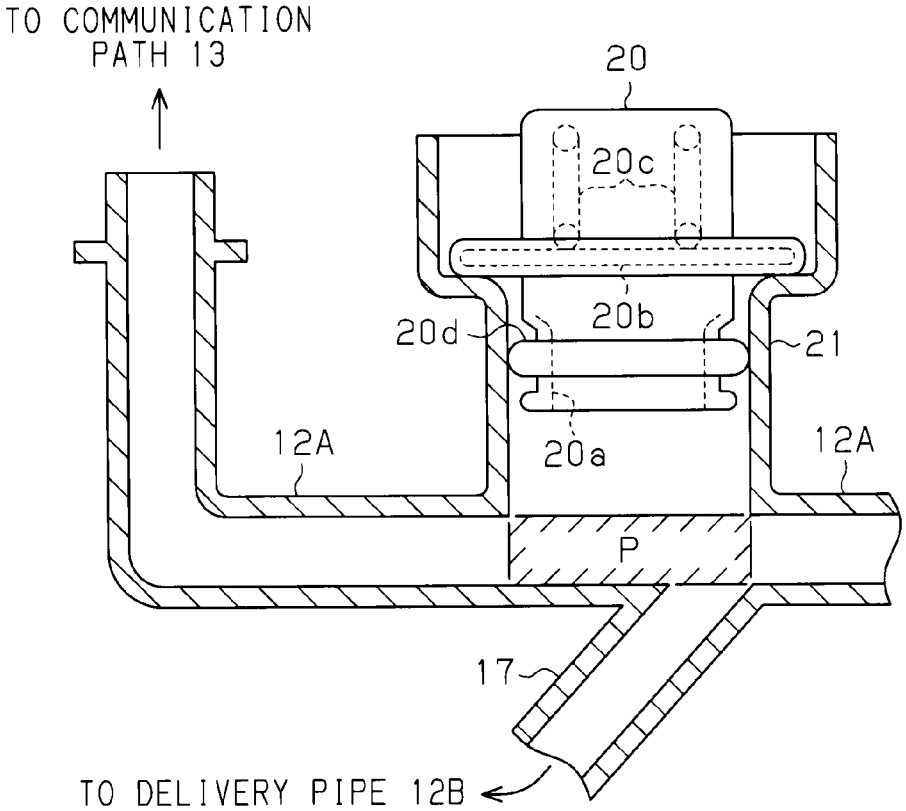
FIG. 2 is cross-sectional view illustrating a portion where a pulsation damper is provided and its surroundings.

FIG. 2 is a cross-sectional view of the portion where the pulsation damper 20 is provided and its surroundings. As illustrated in FIG. 2, a placement channel 21 is provided in the delivery pipe 12A. The placement channel 21 is formed to branch from the delivery pipe 12A at the branch portion between the delivery pipe 12A and the branch path 17. The pulsation damper 20 includes an introduction path 20*a* for introducing fuel pressure therein. The pulsation damper 20 is disposed to block the placement channel 21 with the introduction path 20*a* kept open in the placement channel 21. In this embodiment, the placement channel 21 serves as a pressure introduction path for introducing fuel pressure into the pulsation damper 20.

As such, in this embodiment, the pulsation damper 20 is provided at the branch portion between the delivery pipe 12A and the branch path 17. More specifically, the branch path 17 and the pulsation damper 20 are provided in a manner such that the entire opening of the branch path 17 in the delivery pipe 12A is contained in an opposing portion (indicated with "P" in FIG. 2) on the delivery pipe 12A to which the opening of the placement channel 21 is opposed.

In more detail, the opposing portion P is the position which is located inside the delivery pipe 12A and which is included in the placement channel 21 provided that the placement channel 21 is extended until it penetrates through the delivery pipe 12A.

The pulsation damper 20 includes a diaphragm 20*b* for separating the damper 20 between the portion disposed inside the placement channel 21 and the portion disposed outside the placement channel 21, and a spring 20*c* for resiliently energizing the diaphragm 20*b* into the placement channel 21. The pulsation damper 20 is configured so that the diaphragm 20*b* and the spring 20*c* are elastically deformed to suppress the fuel pressure pulsations inside the pulsation damper 20 as well as fuel pressure pulsations inside each of the delivery pipes 12A and 12B.

Furthermore, the pulsation damper 20 is disposed with an O-ring 20*d* sandwiched between the main body of the damper 20 and the placement channel 21. The O-ring 20*d* seals against fuel leakage between the damper 20 and the placement channel 21.

The pulsation damper 20 disposed in this manner allows fuel pressure pulsations occurring in the two delivery pipes 12A and 12B to transmit to the opposing portion P through the respective paths and then from the opposing portion P to the pulsation damper 20 via the placement channel 21.

Thus, when compared to the configuration in which the branch path 17 is connected such that the opening of the branch path 17 is not included in the opposing portion P, it is possible to transmit each fuel pressure pulse, which has occurred separately in the delivery pipes 12A and 12B, to the pulsation damper 20 while suppressing interference between the pressure pulsations. Since each pressure pulse is conveyed to the opposing portion P through each path, interference of the pressure pulses can be prevented before they reach the opposing portion P. The amplitude of the fuel pressure pulsations can be sufficiently attenuated and thus reduced using the pulsation damper 20.

Also known is a device in which, in addition to the communication path provided with the fuel pump, a return path is also provided. The return path connects the delivery pipe with the fuel tank so that excessive fuel is returned to the fuel tank through the return path. In such a device, part of the fuel pressure pulsation occurred in the delivery pipe is not conveyed to the fuel pump but conveyed to the fuel tank via the return path.

In this embodiment, the return path 19 for returning excessive fuel to the fuel tank 15 is connected to a portion (specifically, on the communication path 13) which is closer to the fuel pump 14 than to the opposing portion P. Thus, all the fuel pressure pulses that have occurred in the delivery pipes 12A and 12B are conveyed toward the fuel pump 14. This configuration tends to increase the degree of the interference of the fuel pressure pulsations having occurred in each of the delivery pipes 12A and 12B, thus causing significant effects. According to this embodiment, pressure pulsations can be advantageously reduced even in a fuel supply device on which pressure pulsations tend to have significant effects.

Furthermore, the opposing portion P is provided closer to the fuel pump 14 than to the three fuel injection valves 16 in the delivery pipe 12A. That is, the opposing portion P where the pulsation damper 20 is disposed is located between all the fuel injection valves 16 provided on each of the delivery pipes 12A and 12B and the fuel pump 14. Accordingly, the fuel pressure pulsation caused by the intermittent opening operation of the fuel injection valves can be sufficiently prevented from being transmitted to the fuel pump 14. The degrading in pumping performance of the fuel pump 14 can be preferably prevented.

Furthermore, both the cross-sectional area of the introduction path 20*a* in the pulsation damper 20 and the cross-sectional area of the placement channel 21 are greater than the cross-sectional area of the delivery pipe 12A and the cross-sectional area of the branch path 17. That is, there is no narrowed cross-sectional area along the path from the delivery pipe 12A into the pulsation damper 20 and along the path from the branch path 17 into the pulsation damper 20. For this reason, when compared to the configuration where there is a narrowed cross-sectional area, the fuel pressure pulsation in the delivery pipe 12A and the fuel pressure pulsation in the branch path 17 are readily transmitted into the pulsation damper 20. This enables adequate suppression of these fuel pressure pulsations.

As described above, this embodiment has the following effects.

(1) The branch path 17 and the pulsation damper 20 are arranged so that the entire opening of the branch path 17 in the delivery pipe 12A is included in the portion P in the delivery pipe 12A to which the opening of the introduction path 20*a* of the pulsation damper 20 is opposed. Thus, it is possible to transmit each fuel pressure pulse having occurred separately in the delivery pipes 12A and 12B to the pulsation damper 20 while suppressing interference of the pressure pulsations. It is also possible to prevent the interference of the fuel pressure pulsations occurred in the two delivery pipes 12A and 12B before they reach the opposing portion P. Accordingly, the amplitude of the fuel pressure pulses can be appropriately attenuated and reduced by the pulsation damper 20.

(2) The placement channel 21, which is branched at the branch portion between the delivery pipe 12A and the branch path 17, is provided, and the pulsation damper 20 is disposed with the introduction path 20*a* of the damper 20 opened to the placement channel 21. Thus, it is possible to transmit each pressure pulse which has been conveyed to the opposing portion P efficiently to the placement channel 21 and eventually into the pulsation damper 20.

(3) The return path 19 is connected to the communication path 13 and serves to return an excess of fuel that has been fed from the fuel pump 14 to the fuel tank 15. Thus, it is possible to suppress pressure pulses advantageously even in a fuel supply device which tends to be seriously affected by pressure pulses.

The above embodiments may also be modified as follows.

The cross-sectional area of the introduction path 20*a* of the pulsation damper 20 and the cross-sectional area of the placement channel 21 may be smaller than the cross-sectional area of the delivery pipe 12A and the cross-sectional area of the branch path 17.

The branch path 17 and the pulsation damper 20 may be arranged so that not the entire opening of the branch path 17 in the delivery pipe 12A but only part of it is included in the opposing portion P. Compare this arrangement with the one where the branch path 17 and the pulsation damper 20 are disposed so that the opening of the branch path 17 is not included in the opposing portion P, each fuel pressure pulse having occurred in each of the delivery pipes 12A and 12B can be transmitted to one pulsation damper 20 while suppressing the interference of the fuel pressure pulses in this arrangement advantageously. Accordingly, this arrangement also allows one pulsation damper 20 to sufficiently attenuate and suppress the amplitude of those fuel pressure pulses.

Figure 3:
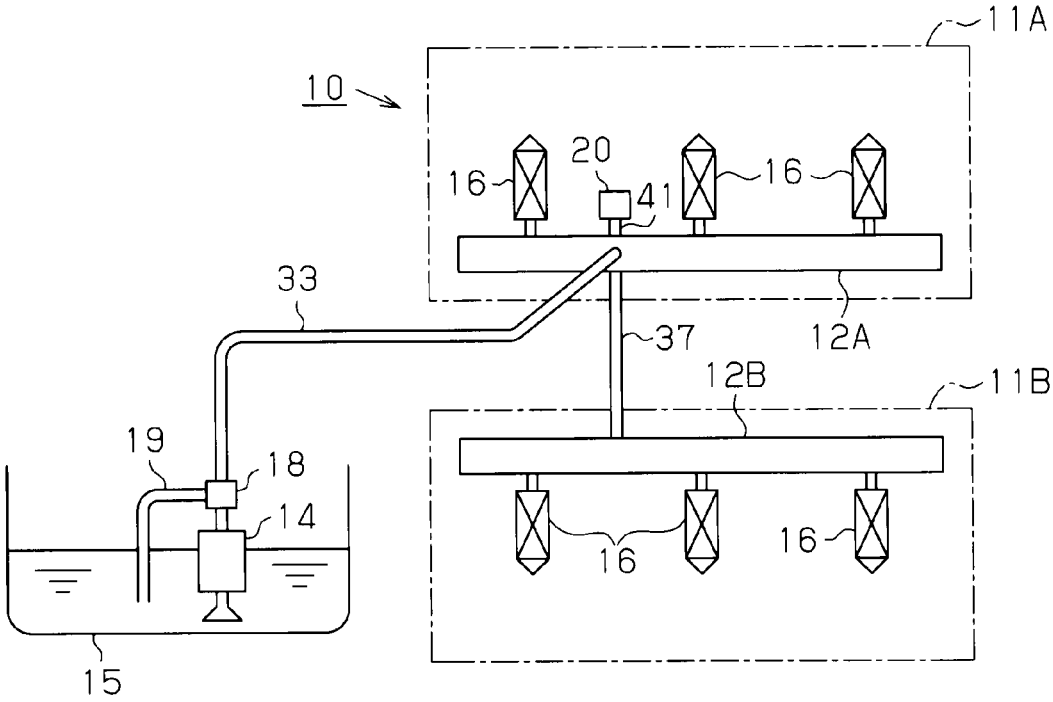
FIG. 3 is a schematic view illustrating another embodiment of the present invention.

As long as a part of the opening of the branch path is included in the opposing portion, it is possible to arbitrarily modify the connection point between the first delivery pipe and the communication path as well as the connection point between the first delivery pipe and the branch path. An example of such an arrangement is illustrated in FIG. 3. In the example illustrated in FIG. 3, a communication path 33 for connecting the fuel tank 15 with the first delivery pipe 12A is connected to an intermediate portion of the delivery pipe 12A (i.e., a portion located between fuel injection valves 16). Furthermore, a branch path 37 in communication with the second delivery pipe 12B and a placement channel 41 in which the pulsation damper 20 is provided are configured to branch from the branch portion of the delivery pipe 12A and the communication path 33.

As long as the pulsation damper 20 is configured to be installed at the branch portion between the delivery pipe 12A and the branch path, the pulsation damper 20 may be installed in any suitable manner. For example, the placement channel may be eliminated, and a new extended portion, which enables the pulsation damper 20 to be provided with the introduction path 20*a* being opened inside the delivery pipe 12A, can be provided. In this case, the introduction path 20*a* serves as a pressure introduction path.

Figure 4:
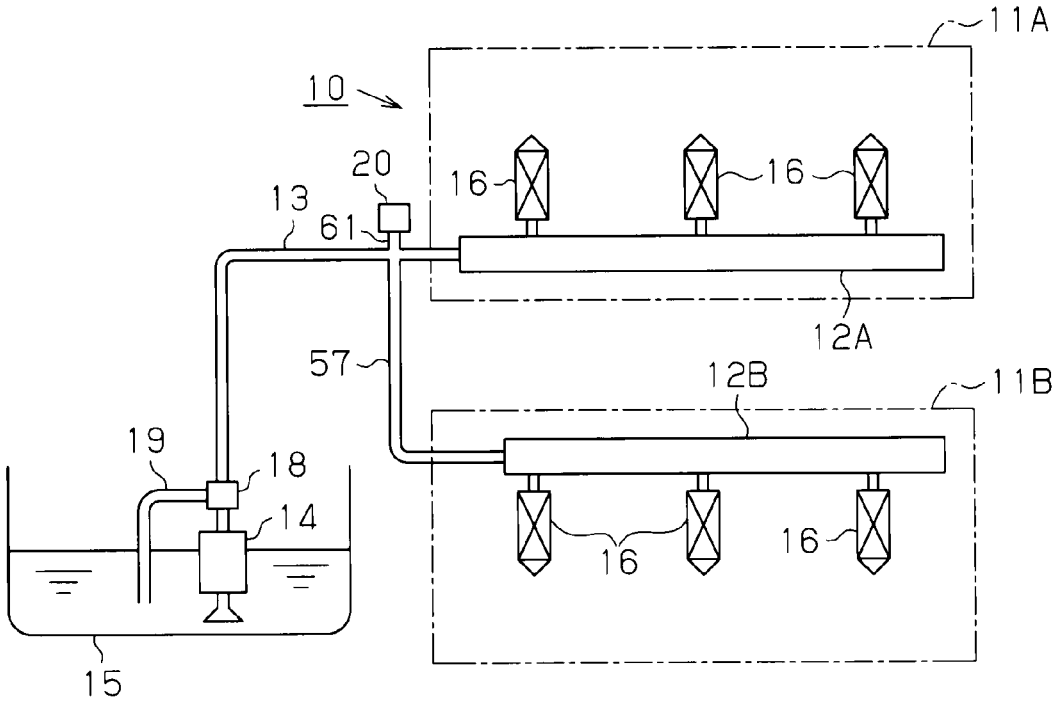
FIG. 4 is a schematic view illustrating still another embodiment of the present invention.

Three paths, which communicate with the delivery pipes 12A and 12B and the fuel tank 15, and a placement channel may be branched from the same portion, with the pulsation damper 20 provided in the placement channel. An example of such configuration is illustrated in FIG. 4. In the example illustrated in FIG. 4, a branch path 57 is provided to connect to the second delivery pipe 12B after being branched from halfway on the communication path 13 that communicates between the fuel pump 14 and the first delivery pipe 12A. Furthermore, a placement channel 61 branches from the branch portion between the communication path 13 and the branch path 57. The pulsation damper 20 is provided in this placement channel 61.

Instead of the pressure regulator provided halfway on the communication path as well as the return path extending from the pressure regulator, a return path and a pressure regulator which communicate the delivery pipes with the fuel tank may be provided.

The number of fuel injection valves disposed on each delivery pipe may differ from one another. Only one fuel injection valve may also be disposed on each delivery pipe.

The present invention is applicable to any type of fuel supply devices so long as they are provided with two fuel injection systems each including a delivery pipe and a fuel injection valve provided in the delivery pipe. For example, the invention may be applied to not only internal combustion engines having o V-shaped cylinder arrangements but also internal combustion engines having horizontally opposing cylinder arrangements, internal combustion engines having W-shaped cylinder arrangements, or internal combustion engines having L-shaped cylinder arrangements. It is understood that those fuel supply devices including three or more fuel injection systems also fall within the scope of the present invention.

The invention claimed is:

1. A fuel supply device for an internal combustion engine, the fuel supply device comprising:

two fuel injection systems and a pulsation damper, each of the two fuel injection systems having a delivery pipe for storing fuel and a fuel injection valve provided in the delivery pipe, the delivery pipe of one fuel injection system being a first delivery pipe, the delivery pipe of the other fuel injection system being a second delivery pipe, wherein the device drives intermittently the fuel injection valve to open while pumping fuel to the two fuel injection systems with a common fuel pump, thereby supplying the fuel within the first and second delivery pipes, a first passageway through which fuel passes, wherein the first passageway includes the first delivery pipe and a communication path for communicating the first delivery pipe with the fuel pump, a second passageway through which fuel passes, wherein the second passageway is branched at a location closer to the fuel pump than to the fuel injection valve in the first passageway and connected to the second delivery pipe, wherein the second passageway includes the second delivery pipe and a branch path, wherein the branch path has an opening at the branch location, and a pressure introduction path for introducing fuel pressure into the pulsation damper, wherein the pressure introduction path has an opening, wherein an opposing portion in the first passageway to which the opening of the pressure introduction path is opposed includes part of the opening of the branch path such that the part of the opening of the branch path opposes to the opening of the pressure introduction path.

2. The fuel supply device for an internal combustion engine according to claim 1, wherein the entire opening of the branch path is included in the opposing portion.

3. The fuel supply device for an internal combustion engine according to claim 1, wherein the pressure introduction path is a placement channel branched from the first passageway, the pulsation damper includes an introduction path for introducing fuel pressure therein, and the introduction path is provided in the placement channel with the introduction path being kept open inside the placement channel.

4. The fuel supply device for an internal combustion engine according to claim 1, wherein a return path for returning excessive fuel inside the first and second passageways to a fuel tank is connected to a portion of the first passageway closer to the fuel pump than to the branch location.

5. The fuel supply device for an internal combustion engine according to claim 1, wherein the internal combustion engine has cylinders in a V-shaped arrangement, and each fuel injection system is disposed in corresponding bank of the internal combustion engine.

* * * * *